US010227854B2

(12) United States Patent
Glass

(10) Patent No.: US 10,227,854 B2
(45) Date of Patent: Mar. 12, 2019

(54) HYDRAULIC FRACTURING SYSTEM

(71) Applicant: Cory Glass, Houston, TX (US)

(72) Inventor: Cory Glass, Houston, TX (US)

(73) Assignee: LIME INSTRUMENTS LLC, Houston, TX (US)

( * ) Notice: Subject to any disclaimer, the term of this patent is extended or adjusted under 35 U.S.C. 154(b) by 851 days.

(21) Appl. No.: 14/590,853

(22) Filed: Jan. 6, 2015

(65) Prior Publication Data

US 2015/0252661 A1 Sep. 10, 2015

Related U.S. Application Data

(60) Provisional application No. 61/924,169, filed on Jan. 6, 2014.

(51) Int. Cl.

| | |
|---|---|
| ***E21B 43/26*** | (2006.01) |
| ***F04B 47/02*** | (2006.01) |
| ***E21B 43/267*** | (2006.01) |

(52) U.S. Cl.

CPC ..... *E21B 43/26* (2013.01); *E21B 43/267* (2013.01); *F04B 47/02* (2013.01)

(58) Field of Classification Search

CPC ..... E21B 43/26; E21B 43/267; F04B 47/02
See application file for complete search history.

(56) References Cited

U.S. PATENT DOCUMENTS

| | | | | |
|---|---|---|---|---|
| 2008/0029267 | A1* | 2/2008 | Shampine | E21B 43/267 166/305.1 |
| 2009/0101410 | A1* | 4/2009 | Egilsson | B66D 1/485 175/24 |
| 2009/0308602 | A1* | 12/2009 | Bruins | E21B 21/062 166/250.01 |
| 2013/0306322 | A1* | 11/2013 | Sanborn | E21B 43/26 166/308.1 |
| 2014/0010671 | A1* | 1/2014 | Cryer | B60W 10/30 417/53 |
| 2014/0096974 | A1* | 4/2014 | Coli | E21B 43/26 166/358 |

* cited by examiner

*Primary Examiner* — Yong-Suk Ro
(74) *Attorney, Agent, or Firm* — Madan Law PLLC

(57) ABSTRACT

A pumping system for use in hydraulic fracturing or fracing of wells. The pumping system is generally self-contained on a transportable system, such as a trailer. The weight and configuration of the trailer must be sized to be hauled legally on United States roadways. The system components include a diesel generator with cooling radiator, a variable-frequency drive (VFD) with cooling system, an A/C induction motor and a high capacity pump. The system may also include a second generator to power other items, such as cooling fans, cooling pumps, lube pumps, lighting and electrical outlets and air conditioning units for cooling equipment. In some embodiments, the system includes single components, while other embodiments include redundant components.

25 Claims, 13 Drawing Sheets

HYDRAULIC FRACTURING SYSTEM

CROSS REFERENCE TO RELATED APPLICATION

This application claims benefit under 35 U.S.C. § 119(e) to U.S. Provisional Application No. 61/924,169, filed Jan. 6, 2014, which is incorporated by reference herein in its entirety.

BACKGROUND OF THE INVENTION

Field of the Invention

The present invention relates generally to a self-contained trailer and tractor used in hydraulic fracturing.

Background Information

Hydraulic fracturing is the fracturing of rock by a pressurized liquid. Some hydraulic fractures form naturally, certain veins or dikes are examples. Induced hydraulic fracturing or hydrofracturing is a technique in which typically water is mixed with sand and chemicals, and the mixture is injected at high pressure into a wellbore to create fractures, which form conduits along which fluids such as gas, petroleum, and groundwater may migrate to the well. The technique is very common in wells for shale gas, tight gas, tight oil, and coal seam gas.

A hydraulic fracture is formed by pumping the fracturing fluid into the wellbore at a rate sufficient to increase pressure downhole to exceed that of the fracture gradient (pressure gradient) of the rock. The fracture gradient is defined as the pressure increase per unit of the depth due to its density and it is usually measured in pounds per square inch per foot or bars per meter. The rock cracks and the fracture fluid continues further into the rock, extending the crack still further, and so on. Operators typically try to maintain "fracture width", or slow its decline, following treatment by introducing into the injected fluid a proppant—a material such as grains of sand, ceramic, or other particulates, that prevent the fractures from closing when the injection is stopped and the pressure of the fluid is reduced. Consideration of proppant strengths and prevention of proppant failure becomes more important at greater depths where pressure and stresses on fractures are higher. The propped fracture is permeable enough to allow the flow of formation fluids to the well. Formation fluids include gas, oil, salt water, fresh water and fluids introduced to the formation during completion of the well during fracturing.

Fracturing is typically performed by large diesel-powered pumps. Such pumps are able to pump fracturing fluid into a wellbore at a high enough pressure to crack the formation, but they also have drawbacks. For example, diesel pumps are very heavy, and thus must be moved on heavy duty trailers, making transporting the pumps between oilfields expensive and inefficient. In addition, the diesel engines required to drive the pumps require a relatively high level of maintenance.

What is needed is a pump system that overcomes the problems associated with diesel pumps.

SUMMARY OF THE INVENTION

The present invention relates to a system for use in a fracturing plant. Equipment is mounted on a trailer and is delivered to a well site with a tractor. Pumps are powered by diesel generators mounted on the trailer and controlled by associated electronics.

In one embodiment, a fracturing system for use at a fracturing site is disclosed, the system includes, optionally, at least one tractor unit having multiple axles; at least one trailer unit, the at least one trailer unit including: one or more well service pumps; one or more induction motors with cooling fans, the one or more electric induction motors being coupled to the well service pumps via pulley assemblies or transmissions; one or more variable frequency drives (VFD) with a cooling system, the one or more variable frequency drives being coupled to the induction motors; a diesel generator coupled to the motors and VFD; and optionally a cooling radiator coupled to the diesel motor.

In one aspect, each of the one or more well service pumps is capable of supplying at least 3500 horsepower. In another aspect, each of the one or more electric induction motors is capable of supplying at least 2000 horsepower.

In another aspect, the combined weight of a single tractor and trailer is less than 127,600 pounds. In a further aspect, the one or more electric induction motors are mounted on the one or more well service pumps.

In one aspect, the well service pump is a quintuplex plunger-style fluid pump. In another aspect, the well service pump is a triplex plunger-style fluid pump.

In a further aspect, the at least one trailer includes two well service pumps and each well service pump is coupled to two induction motors. In a related aspect, the at least one trailer includes two quintuplex plunger-style fluid pumps capable of supplying at least 3000 horsepower, two A/C induction motors mounted on each fluid pump capable of supplying at least 1600 horsepower, two 4000 horsepower A/C VFDs, a VDF cooling system, and optionally an auxiliary diesel generator, where the auxiliary diesel generator powers auxiliary equipment, lube pumps, and cooling fans, and where the induction motor and fluid pump are coupled via pulley assemblies.

In one aspect, the at least one trailer includes one well service pump coupled to one induction motor. In a related aspect, the at least one trailer includes one quintuplex plunger-style fluid pump capable of supplying at least 3500 horsepower, an A/C induction motor capable of supplying at least 2000 horsepower, a 4000 horsepower A/C VDF drive, and an auxiliary diesel generator, where the auxiliary diesel generator powers auxiliary equipment, lube pumps, and cooling fans, and where the induction motor and fluid pump are coupled via transmission.

In one aspect, electric induction motor function is diagnosed via separate operator interface terminal. In another aspect, the well service pumps and electric induction motors are horizontal. In a further aspect, the system is disposed on shore or off-shore.

In another embodiment, a fracturing system for use at a fracturing site is disclosed, the system includes optionally, at least one tractor unit having multiple axles; at least one trailer unit having multiple axles releasably coupled with the at least one tractor unit, the at least one trailer unit including: one or more well service pumps, where the service pumps are quintuplex or triplex plunger-style fluid pumps; one or more induction motors with cooling fans, the one or more electric induction motors being coupled to the well service pumps via pulley assemblies or transmissions; one or more variable frequency drives (VFD) with a cooling system, the one or more variable frequency drives being coupled to the induction motors; and a diesel generator coupled to the motors and VFD.

In a related aspect, the at least one trailer includes two quintuplex plunger-style fluid pumps capable of supplying at least 3000 horsepower, two A/C induction motors mounted on each fluid pump capable of supplying at least 1600 horsepower, two 4000 horsepower A/C VFDs, a VDF cooling system, and optionally an auxiliary diesel generator, where the auxiliary diesel generator powers auxiliary equipment, lube pumps, and cooling fans, and where the induction motors and fluid pump are coupled via pulley assemblies.

In another related aspect, the at least one trailer includes one quintuplex plunger-style fluid pump capable of supplying at least 3500 horsepower, an A/C induction motor capable of supplying at least 2000 horsepower, a 4000 horsepower A/C VDF drive, and an auxiliary diesel generator, where the auxiliary diesel generator powers auxiliary equipment, lube pumps, and cooling fans, and where the induction motor and fluid pump are coupled via transmission.

In one embodiment, a method of delivering fracturing fluid to a wellbore is disclosed, the method includes providing to a wellbore site at least one trailer unit having multiple axles releasably coupled with the at least one tractor unit, the at least one trailer unit including: one or more well service pumps, one or more induction motors with cooling fans, the one or more electric induction motors being coupled to the well service pumps via pulley assemblies or transmissions, one or more variable frequency drives (VFD) with a cooling system, the one or more variable frequency drives being coupled to the induction motors, a diesel generator coupled to the motors and VFD, and optionally a cooling radiator coupled to the diesel motor; and operating components in the trailer to pump the fracturing fluid from the surface to the wellbore.

In a related aspect, the at least one trailer includes two quintuplex plunger-style fluid pumps capable of supplying at least 3000 horsepower, two A/C induction motors mounted on each fluid pump capable of supplying at least 1600 horsepower, two 4000 horsepower A/C VFDs, a VDF cooling system, and optionally an auxiliary diesel generator, where the auxiliary diesel generator powers auxiliary equipment, lube pumps, and cooling fans, and where the induction motors and fluid pump are coupled via pulley assemblies.

In another related aspect, the at least one trailer includes one quintuplex plunger-style fluid pump capable of supplying at least 3500 horsepower, an A/C induction motor capable of supplying at least 2000 horsepower, a 4000 horsepower A/C VDF drive, and an auxiliary diesel generator, where the auxiliary diesel generator powers auxiliary equipment, lube pumps, and cooling fans, and where the induction motor and fluid pump are coupled via transmission.

In one embodiment, a fracturing system for use at a fracturing site is disclosed, the system including optionally, at least one tractor unit having multiple axles; at least one trailer unit, the at least one trailer unit including: one or more well service pumps; one or more horizontal induction motors, the one or more electric induction motors being coupled to the well service pumps via pulley assemblies or transmissions; one or more variable frequency drives (VFD) with a cooling system, the one or more variable frequency drives being coupled to the induction motors; a diesel generator coupled to the motors and VFD; and optionally a cooling radiator coupled to the diesel motor.

In a related aspect, the at least one trailer includes two triplex plunger-style fluid pumps, two A/C induction motors mounted on each fluid pump capable of supplying at least 1600 horsepower, two 4000 horsepower A/C VFDs, a VDF cooling system, and optionally an auxiliary diesel generator, where the auxiliary diesel generator powers auxiliary equipment, lube pumps, and cooling fans, and where the induction motor and fluid pump are coupled via pulley assemblies.

In another related aspect, the at least one trailer includes one 3500 horsepower quintuplex plunger-style fluid pump, an A/C induction motor capable of supplying at least 2000 horsepower, a 4000 horsepower A/C VDF drive, and an auxiliary diesel generator, wherein said auxiliary diesel generator powers auxiliary equipment, lube pumps, and cooling fans, and wherein said induction motor and fluid pump are coupled via transmission.

In a further related aspect, the trailer is a 46 foot step deck trailer or a 40 foot step deck trailer.

In another embodiment, a method of delivering fracturing fluid to a wellbore is disclosed, the method including providing to a wellbore site at least one trailer unit, the at least one trailer unit including:

(i) a two triplex plunger-style fluid pumps, two A/C induction motors mounted on each fluid pump capable of supplying at least 1600 horsepower, two 4000 horsepower A/C VFDs, a VDF cooling system, and optionally an auxiliary diesel generator, where the auxiliary diesel generator powers auxiliary equipment, lube pumps, and cooling fans, and where the induction motor and fluid pump are coupled via pulley assemblies or (ii) two quintuplex plunger-style fluid pumps, two A/C induction motors mounted on the trailer capable of supplying at least 1600 horsepower, two 4000 horsepower A/C VFDs, a VDF cooling system, and optionally an auxiliary diesel generator, where the auxiliary diesel generator powers auxiliary equipment, lube pumps, and cooling fans, and where the induction motor and fluid pump are coupled via pulley assemblies, and operating components in the trailer to pump the fracturing fluid from the surface to the wellbore.

DETAILED DESCRIPTION OF THE INVENTION

Figure 1:
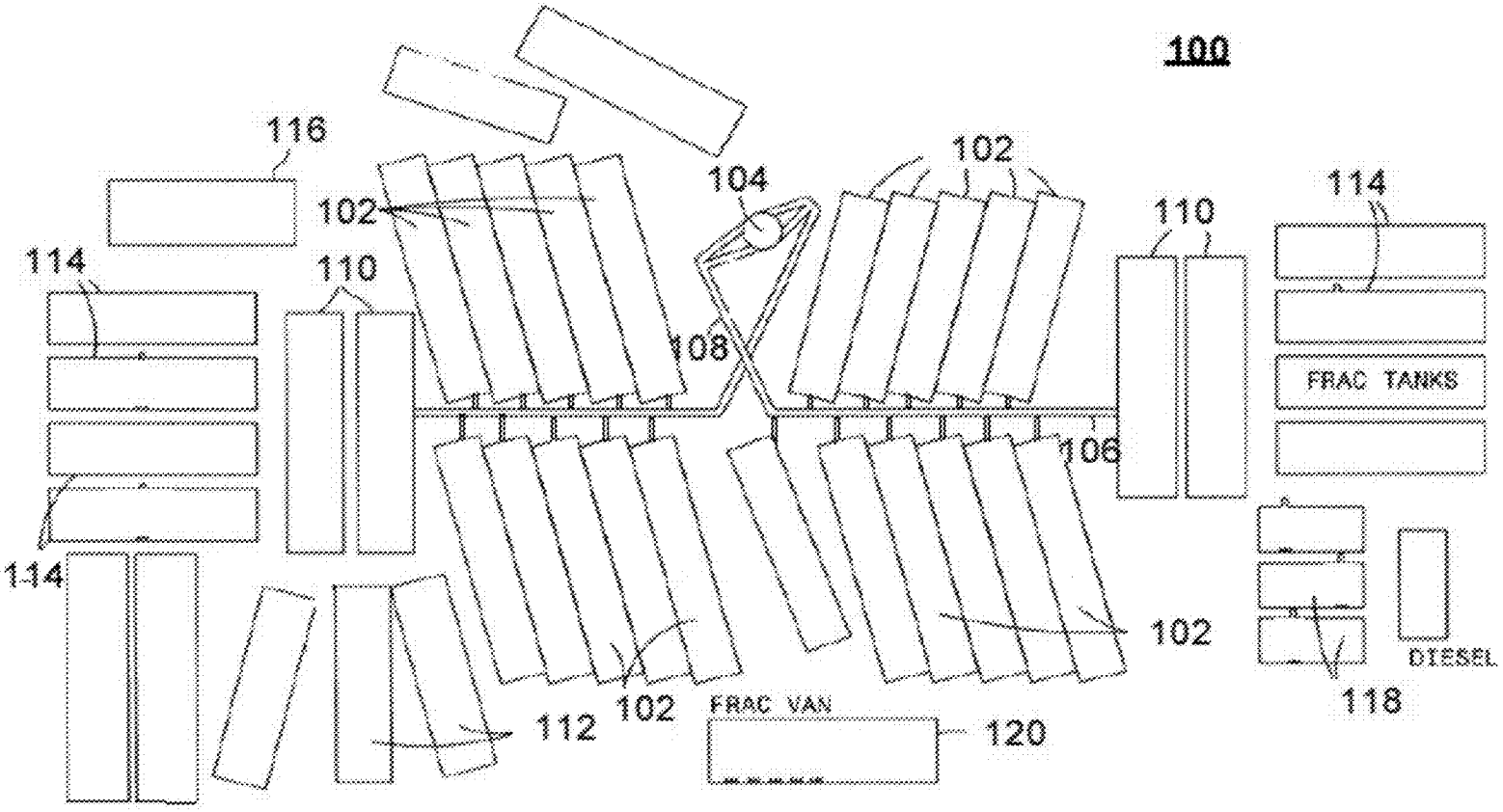
FIG. 1 is one embodiment of a plan view showing a fracturing site and fracturing equipment used at the site.

Before the present devices, methods, and methodologies are described, it is to be understood that this invention is not limited to particular devices, methods, and conditions described, as such devices, methods, and conditions may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "a pump" includes one or more pumps, and/or devices of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Any methods and materials similar or equivalent to those described herein can be used in the practice or testing of the invention, as it will be understood that modifications and variations are encompassed within the spirit and scope of the instant disclosure.

As used herein, "about," "approximately," "substantially" and "significantly" will be understood by a person of ordinary skill in the art and will vary in some extent depending on the context in which they are used. If there are uses of the term which are not clear to persons of ordinary skill in the art given the context in which it is used, "about" and "approximately" will mean plus or minus <10% of particular term and "substantially" and "significantly" will mean plus or minus >10% of the particular term.

As used herein, "footprint" means the on-site area required to accommodate a fracturing operation.

As used herein, "trailer unit" may be a trailer that is part of a tractor-trailer or a container which is mountable onto a trailer that is part of a tractor-trailer.

The technique of hydraulic fracturing is used to increase or restore the rate at which fluids, such as petroleum, water, or natural gas can be recovered from subterranean natural reservoirs. Reservoirs are typically porous sandstones, limestones or dolomite rocks, but also include "unconventional reservoirs" such as shale rock or coal beds. Hydraulic fracturing enables the production of natural gas and oil from rock formations deep below the earth's surface. At such depths, there may not be sufficient permeability or reservoir pressure to allow natural gas and oil to flow from the rock into the wellbore at economic rates. Thus, creating conductive fractures in the rock is pivotal to extract gas from shale reservoirs because of the extremely low natural permeability of shale. Fractures provide a conductive path connecting a larger volume of the reservoir to the well. So-called "super fracing", which creates cracks deeper in the rock formation to release more oil and gas, will increase efficiency of hydraulic fracturing.

High-pressure fracture fluid is injected into the wellbore, with the pressure above the fracture gradient of the rock. The two main purposes of fracturing fluid is to extend fractures and to carry proppant into the formation, the purpose of which is to stay there without damaging the formation or production of the well.

The blended fluids, under high pressure, and proppant are pumped into the well, fracturing the surrounding formation. The proppant material will keep an induced hydraulic fracture open, during or following a fracturing treatment. The proppant material holds the fractured formation open to enhance rate of gas or oil recovery. The fluid is normally water. A polymer or other additive may be added to the water to decrease friction loss as the water is pumped down a well. Water containing the polymer is usually called "slick water." Other polymers may be used during a treatment to form a more viscous fluid. Proppant is added to the fluid to prevent closure of fractures after pumping stops.

Fluids make tradeoffs in such material properties as viscosity, where more viscous fluids can carry more concentrated proppant; the energy or pressure demands to maintain a certain flux pump rate (flow velocity) that will conduct the proppant appropriately; pH, various theological factors, among others. Types of proppant include silica sand, resin-coated sand, and man-made ceramics. These vary depending on the type of permeability or grain strength needed. The most commonly used proppant is silica sand, though proppants of uniform size and shape, such as a ceramic proppant, is believed to be more effective. Due to a higher porosity within the fracture, a greater amount of oil and natural gas is liberated.

The fracturing fluid varies in composition depending on the type of fracturing used, the conditions of the specific well being fractured, and the water characteristics. A typical fracture treatment uses between 3 and 12 additive chemicals. Although there may be unconventional fracturing fluids, the more typically used chemical additives can include one or more of the following:

- Acid—hydrochloric acid (usually 28%-5%), or acetic acid is used in the pre-fracturing stage for cleaning the perforations and initiating fissure in the near-wellbore rock.
- Sodium chloride (salt)—delays breakdown of the gel polymer chains.
- Polyacrylamide and other friction reducers—minimizes the friction between fluid and pipe, thus allowing the pumps to pump at a higher rate without having greater pressure on the surface.
- Ethylene glycol—prevents formation of scale deposits in the pipe.
- Borate salts—used for maintaining fluid viscosity during the temperature increase.

Sodium and potassium carbonates—used for maintaining effectiveness of crosslinkers.

Glutaraldehyde—used as disinfectant of the water (bacteria elimination).

Guar gum and other water-soluble gelling agents—increases viscosity of the fracturing fluid to deliver more efficiently the proppant into the formation.

Citric acid—used for corrosion prevention.

Isopropanol—increases the viscosity of the fracture fluid.

Hydraulic-fracturing equipment used in oil and natural gas fields usually consists of a slurry blender, one or more high-pressure, high-volume fracturing pumps (typically powerful triplex or quintuplex pumps) and a monitoring unit. Associated equipment includes fracturing tanks, one or more units for storage and handling of proppant, high-pressure treating iron, a chemical additive unit (used to accurately monitor chemical addition), low-pressure flexible hoses, and many gauges and meters for flow rate, fluid density, and treating pressure.

The system as disclosed herein has the advantage of being able to use pumps containing primer movers that produce horsepower greater 2250 and still fit a standard trailer (see, cf., U.S. Publication No. 2008/0029267, herein incorporated by reference in its entirety).

In embodiments, each pump may be rated for about 2500 horsepower or more. In addition, the components of the system as described, including the pumps and electric motors may be capable of operating during prolonged pumping operations, and at temperatures in the range of about 0° C. or lower to about 55° C. or greater. In addition, each electronic motor is coupled with a variable frequency drive (s) (VFD), and an A/C console, that controls the speed of the electric motor, and hence the speed of the pump. In a related aspect, the electric induction motor function is diagnosed via separate operator interface terminal, using software specifically designed for such diagnosis.

The VFDs of the instant disclosure may be discrete to each vehicle and/or pump. Such a feature is advantageous because is allows for independent control of the pumps and motors. Thus, if one pump goes offline, the remaining pumps and motors on the vehicle on in the fleet of vehicles can continue to function, thereby adding redundancy and flexibility to the system. In addition, separate control of each pump/motor by an operator makes the system more scalable, because individual pumps/motors can be added or removed form a site without modification of the VFD.

FIG. 1 shows a plan view of one embodiment of fracturing equipment of the present invention used in a fracturing site 100. The formation of each fracture requires injection of hundreds of thousands of gallons of fluid under high pressure supplied by pumps 102, which are mounted on trailers. The trailers remain at the well site throughout treatment of well 104. Manifold 106 connects pumps 102 to flow line 108, which is connected to well 104. Fluid and additives are blended in blender 110 and taken by manifold to the intake or suction of pumps 102. Proppant storage vessels 112 and liquid storage vessels 114 may be used for maintaining a supply of materials during a treatment. Quality control tests of the fluid and additives may be performed in structure 116 before and during well treatments. Fuel for prime movers of the pumps may be stored in tanks 118. The site may also include a control vehicle 120 for the operators.

Pump control and data monitoring equipment may be mounted on a control vehicle 120, and connected to the pumps, motors, and other equipment to provide information to an operator, and allow the operator to control different parameters of the fractioning operation.

Advantages of the present system include:

1) Motors and pumps are integrated with the trailer.

2) A/C induction motors on the trailer powers the pumps.

3) The system may be powered by a 4160v 3 phrase AC power source at the site.

4) One or more diesel generators mounted on the trailer to power the induction motors. Diesel generators mounted on the unit may be used for auxiliary power which will supply power to small 480V AC motors such as lube pumps, cooling fans and lights when the unit is not connected to a main power source.

5) The trailer is self-contained and can function independently of other trailers or equipment at the site.

6) Variable-frequency drive (VFD) and associated cooling system is mounted on each trailer (including a motor control center or MCC).

7) Physical footprint reduced relative to system necessary to produce same hp.

In embodiments, the pump has a maximum rating of 3000 horsepower. A conventional diesel powered fluid pump is rated for 2250 horsepower (hp). However, due to parasitic losses in the transmission, torque converter and cooling systems, diesel fueled systems typically provide 1800 hp to the pumps. In contrast, the present system can deliver true 2500 hp (or greater) directly to each pump because the pump is directly coupled to electric motors. Further, the nominal weight of a conventional pump is up to 120,000 lbs. In the present disclosure, each fracturing unit (e.g., pump, electric motor) may be about 37,000 lbs., thus allowing for the placement of about 3 pumps in the same physical dimension (size and weight) as the spacing needed for a single pump in conventional diesel systems, as well as allowing for up to 10,000 hp total (or more) to the pumps. In other embodiments, more or fewer units may be located in a smaller footprint, to give the same or more power relative to conventional systems.

In embodiments, fracturing units may include one or more electric motors capable of operation in the range of up to 2800 rpm. Fracturing units may also include one or more pumps that are plunger-style fluid pumps coupled to the one or more electric motors. In other embodiments, the trailer unit containing the system may have dimensions of approximately 8.5' width×48' length×9.2' height, and component weight up to approximately 110,000 lbs. These dimensions would allow the fracturing system as disclosed to be easily transported by conventional tractor trailer systems.

In embodiments, the system is self-contained in that the motors are powered by a diesel generator mounted on the same trailer, including that in some embodiments, said system may have an additional auxiliary diesel generator which powers auxiliary equipment, lube pumps, cooling fans and the like.

Figure 2:
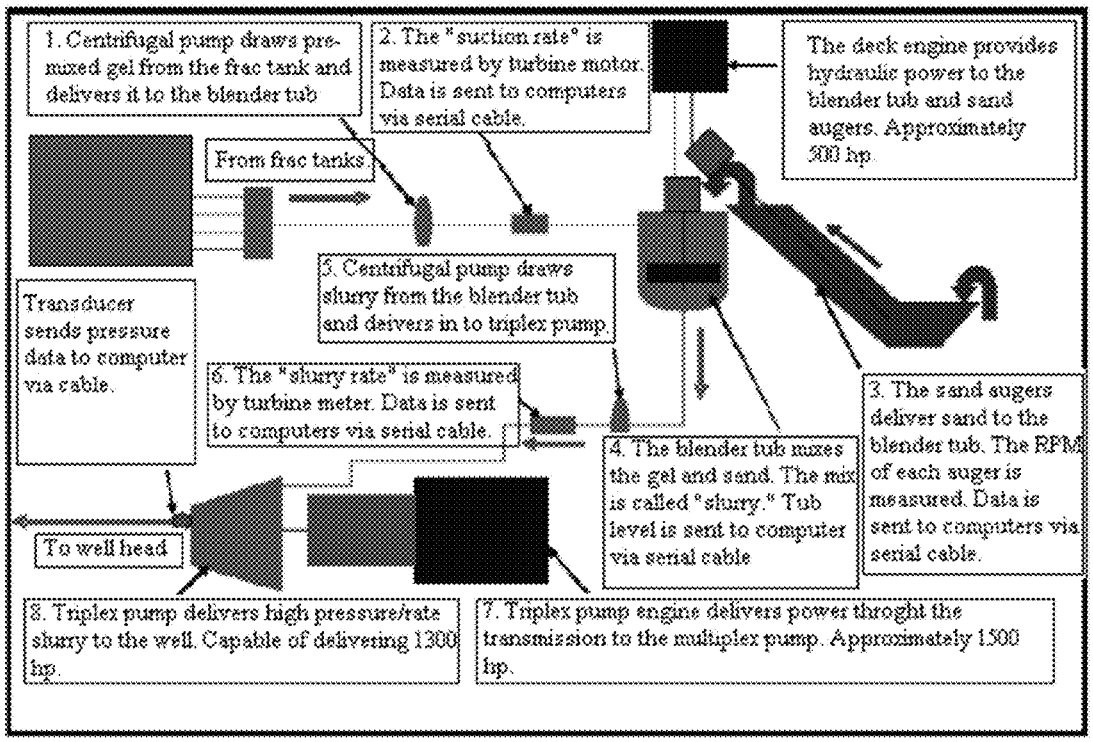
FIG. 2 is a diagram schematically showing one embodiment of how the equipment of FIG. 1 may function with the other equipment at the fracturing site

FIG. 2 is a diagram showing schematically one embodiment 200 of how this equipment may function together. The steps may include:

2. Centrifugal pump draws pre mixed gel from the frac tank and delivers it to the blender tub.
3. The "suction rate" is measured by magnetic and turbine flow meters. Data is sent to computers.
4. The sand augers deliver sand to the blender tub. The RPM of each auger is measured. Data is sent to computers.
5. The blender tub mixes the gel and sand. The mix is called "slurry." Tub level sent to computer.
6. Centrifugal pump draws slurry from the blender tub and delivers it to the triplex pump.

7. The "slurry rate" is measured by magnetic and turbine flow meters. Data is sent to computers.
8. Triplex (or quintuplex) pump engine delivers power, through the transmission, to the triplex pump. Approximately 1500 hp.
9. Triplex (or quintuplex) pump delivers high pressure/rate slurry to the well. Capable of delivering 1300 to 3500 hp.

Measurements of the pressure and rate during the growth of a hydraulic fracture, as well as knowing the properties of the fluid and proppant being injected into the well provides the most common and simplest method of monitoring a hydraulic fracture treatment. This data, along with knowledge of the underground geology may be used to model information such as length, width and conductivity of a propped fracture.

While the hydraulic fracturing embodiments described herein may be described generally for production from oil and gas wells, hydraulic fracturing may also be applied:

To stimulate groundwater wells.

To precondition or induce rock to cave in mining.

As a means of enhancing waste remediation processes, usually hydrocarbon waste or spills.

To dispose of waste by injection into deep rock formations.

As a method to measure the stress in the Earth.

For heat extraction to produce electricity in enhanced geothermal systems.

To increase injection rates for geologic sequestration of $CO_2$.

Figure 3A:
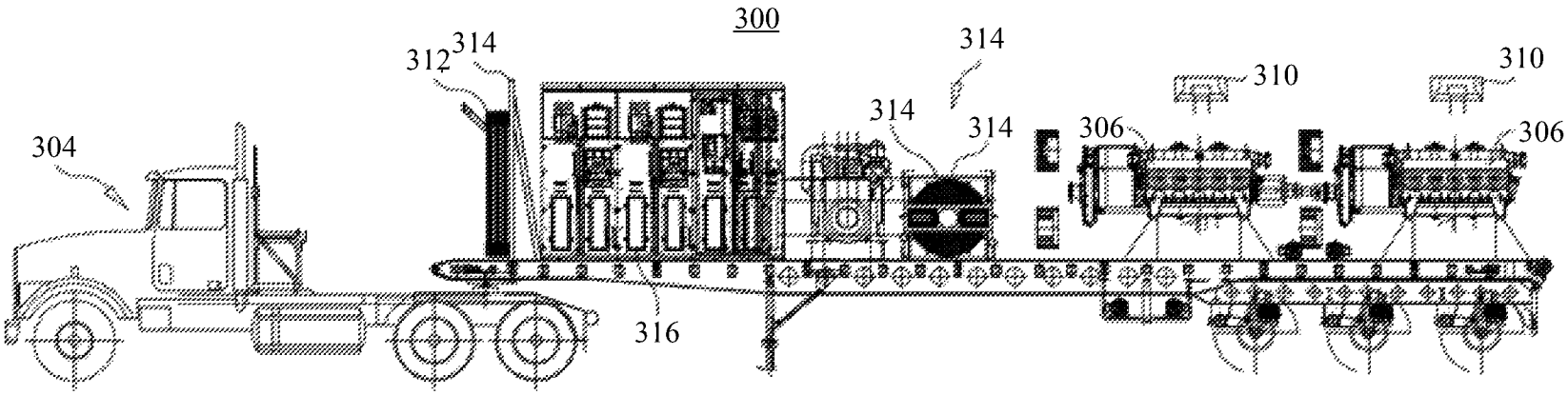
FIG. 3A shows a side view of a four axle hydraulic fracturing trailer unit connected to a three axle tractor.
Figure 3B:
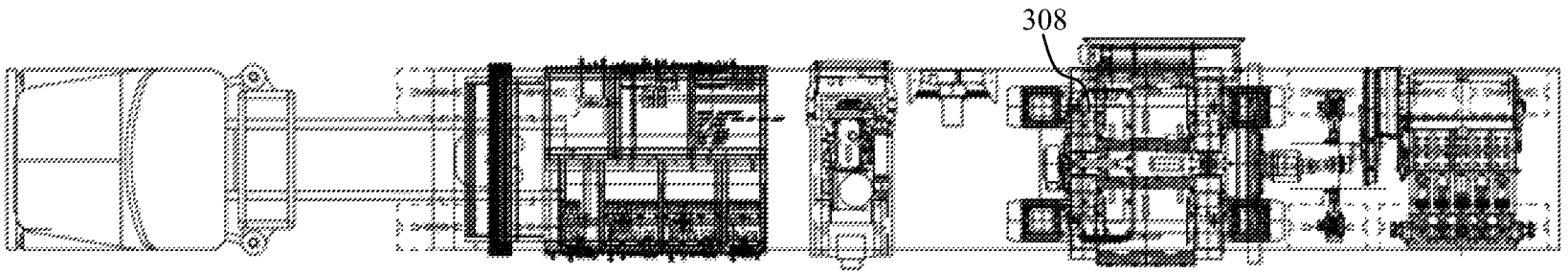
FIG. 3B shows a top view of the four axle hydraulic fracturing trailer unit and three axle tractor of FIG. 3A.
Figure 3C:
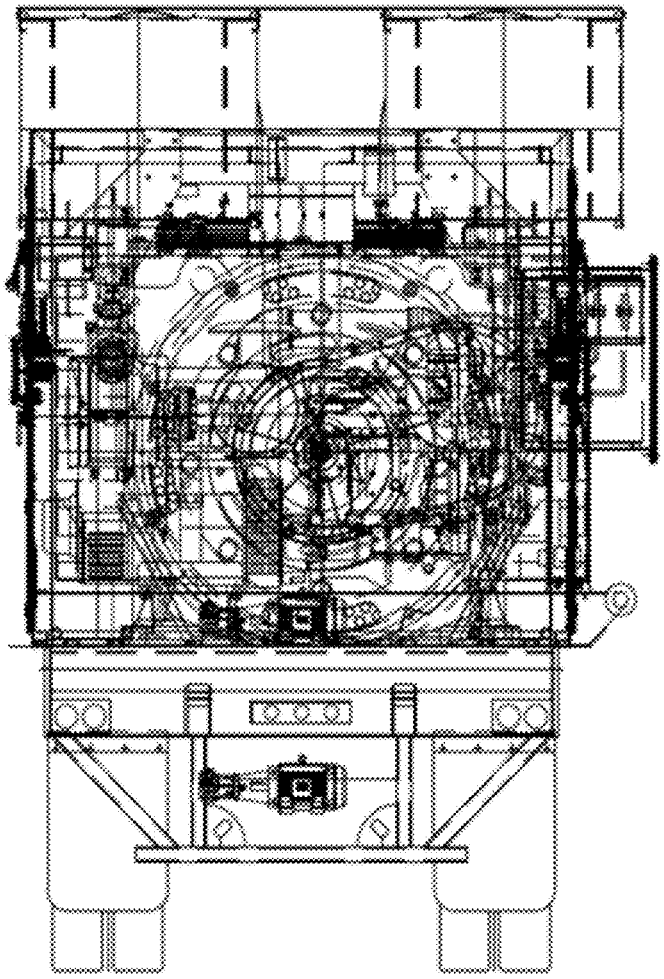
FIG. 3C shows a rear end view of a four axle hydraulic fracturing trailer unit of FIG. 3A.

FIGS. 3A-3C show side, top and rear views of one embodiment of a fracturing system 300 using a four axle hydraulic fracturing trailer unit 302 and releasably connected to a three axle tractor 304. The system 300 is designed to have a combined weight of the tractor and trailer of less than 127,600 pounds, so that it legally travel on United States roadways to the fracturing site. In some embodiments, the tractor 304 stays with the trailer unit 302, while in other embodiments, tractor 304 may be disconnected from trailer unit 302 and used to remove or retrieve another trailer unit 302 to the site. Tractor 304 may also be used to bring other equipment to the site, such as a blender, chemicals, fuel, or other needed items. The tractor may be a KENWORTH® T880, a FREIGHTLINER® 122SD, PETERBILT® 579, 389, 384, or the like.

The trailer unit 302 includes many components used at the fracturing site shown in FIG. 1. In the embodiment shown, the system includes two pumps 306 (e.g., triplex, quadruplex, quintuplex), each pump is powered by two induction motors 308 (e.g., 1600 hp AC induction motor, available from General Electric, Siemens, Morelli Motori SPA, ATB, weight about 15,000 lbs), cooled by cooling fans 310. The induction motors 308 are connected to the pumps 306 with various pulleys and belts (e.g., as shown 3 pulleys/belts, with guard and pedestal mount for the ends of the pinion shaft; in embodiments the pulley/belts, guard, pedestal mount weigh about 1000 lbs each). The pumps are fluidly coupled to the fracturing site fluid source, and configurable to pressurize a fluid to at least a fracturing pressure. Power on the trailer is supplied by a diesel generator 312 with a cooling radiator 314. Two variable-frequency drives (VFD) 316 are used to control the motor speed and torque by varying the motor input frequency and voltage. There are also various cables 318 connecting the equipment (e.g., cable from the drive to the motor will run through the trailer frame). In the present system, 2500-3200 hp can be delivered to each pump 306 because each pump 306 is directly coupled to 2 AC induction motors 308. Further, each pump 306 and induction motor 308 is modular, allowing for facile removal and replacement when necessary.

Below are some examples of the type of equipment that may be used in the system. While particular names and ratings are listed, other equivalent equipment may be used. There are many different pumps 306 that will work in the present system. One example is a Gardner Denver GD-3000 quintuplex well service pump that has an output of 3.000 BHP. Each pump weighs approximately 19,000 lbs (38,000 lbs for both). While this is a quintuplex pump, other pumps, such as a triplex pump may also work. The induction motors 308 may be 1600 HP A/C induction motors. The generator 312 may be a 200 HP Cummins diesel generator weighing 2000 lbs. used to power auxiliary equipment, although higher rated generator sets may be used (i.e., those providing enough hp to drive the electric motors as disclosed: e.g., Cummings QST30 series available from Cummings Inc., Minneapolis, Minn.). To cool the generator, a 250 gallons per minute radiator may be used. The variable-frequency drives (VFD) 316 may be 4000 HP A/C VFD drives with cooling systems weighing approximately 18,000 lbs.

Along with this equipment, there may also be other auxiliary equipment on the trailer. For example, in one embodiment, the system may include a second generator set, such as a 160 HP (60) volt generator to run:

one 40 HP cooling fan to run the cooling radiator.

two 10 HP cooling pumps to cool the 1600 HP motors.

two 10 HP lube cooling fans.

two 10 HP lube pumps (one for each pump).

six fluorescent lights (lighting transformer and lighting panel).

110 volt outlet.

twelve 30 amp 2 ton A/C units.

In use, the system 300 is brought into the fracturing site 100 and inserted into one of the pump openings 12. The pumps 406 are then attached to the manifold 14. The generator is started and the mechanicals and electrics of the system are brought up to speed. Fluid plus additives are then taken by manifold to the intake of the pumps and then pumped to the well 10. The flow rate is controlled by the VFD drive.

Figure 4A:
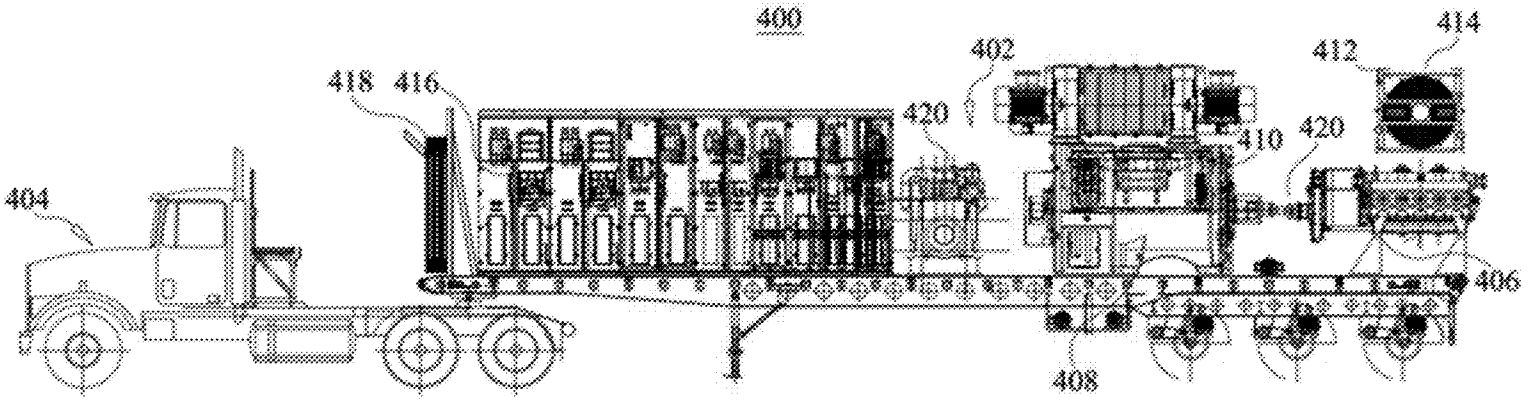
FIG. 4A shows a side view of a three axle hydraulic fracturing trailer unit connected to a two axle tractor.
Figure 4B:
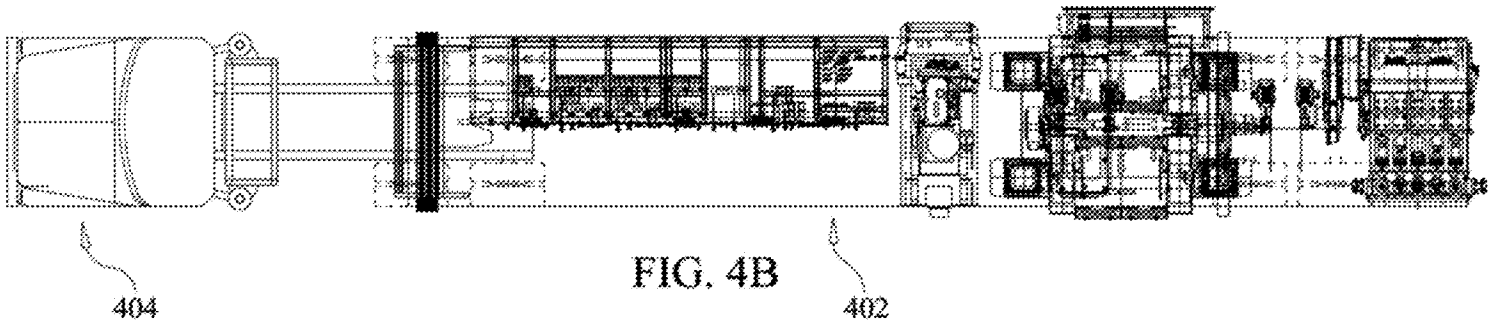
FIG. 4B shows a top view of the three axle hydraulic fracturing trailer unit and two axle tractor of FIG. 4A.
Figure 4C:
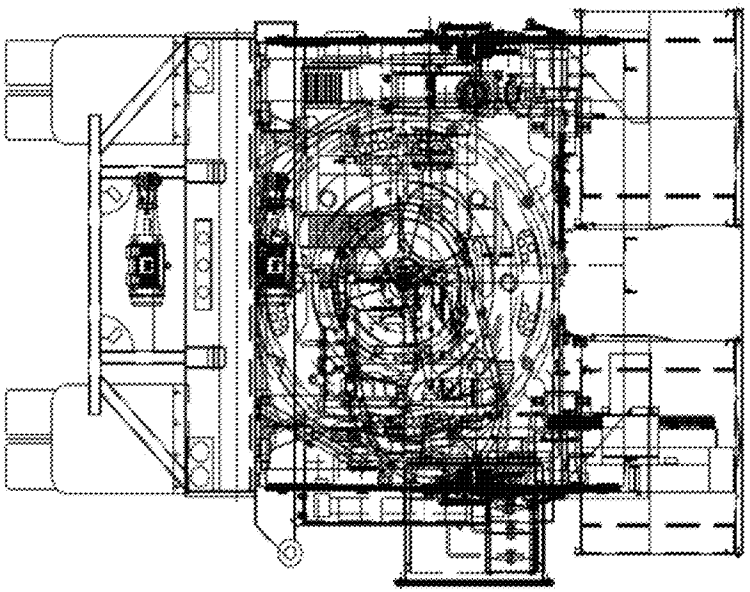
FIG. 4C shows a rear end view of a three axle hydraulic fracturing trailer unit of FIG. 4A.

FIGS. 4A-4C show side, top and rear views of one embodiment of a fracturing system 400 using a three axle hydraulic fracturing trailer unit 402 and releasably connected to a two axle tractor 404. The system 400 is designed to have a combined weight of the tractor and trailer of less than 127,600 pounds, so that it may legally travel on United States roadways to the fracturing site. In some embodiments, the tractor 404 stays with the trailer unit 402, while in other embodiments, tractor 404 may be disconnected from trailer unit 402 and used to remove or retrieve another trailer unit 402 to the site. Tractor 404 may also be used to bring other equipment to the site, such as a blender, chemicals, fuel, or other needed items. The tractor may be a KENWORTH® T880, a FREIGHTLINER® 122SD, PETERBILT® 579, 389, 384, or the like.

The trailer unit 402 includes many components used at the fracturing site shown in FIG. 1. The trailer unit 402 is similar to trailer unit 302 discussed above, and carries the same types of equipment, but in less numbers and weighs less. That is one reason the trailer 402 may be towed by a two axle tractor 404 instead of a three axle tractor 304. In the embodiment shown, the system includes pump 406 powered by an induction motor 408 cooled by cooling fan 410. The induction motor 408 is connected to the pump 406 via drive train, transmission and torque converter 421. The pump is fluidly coupled to the fracturing site fluid source, and configurable to pressurize a fluid to at least a fracturing pressure. Power on the trailer is supplied by a diesel generator 412 with a cooling radiator 414. A variable-frequency drive (VFD) 416 is used to control the motor speed and torque by varying the motor input frequency and voltage. There are also various cables 418 connecting the equipment.

Below are some examples of the type of equipment that may be used in the system. While particular names and ratings are listed, other equivalent equipment may be used. There are many different pumps 406 that will work in the present system. One example is a Weir SPM quintuplex well service pump that has an output of 3,500 BHP with an approximate weight of 19,000 lbs. While this is a quintuplex pump, other pumps, such as a triplex pump may also be used. The induction motors 408 may be 2680 HP A/C induction motors. The generator 412 may be a 126-160 HP diesel generator weighing 3500 lbs. The variable-frequency drive (VFD) 416 may be 4000 HP A/C VFD drive with cooling system weighing approximately 8,000 lbs.

Along with this equipment, there may also be other auxiliary equipment on the trailer. For example, in one embodiment, the system may include a second generator 420, such as a 60 HP 600 volt generator to run:

- cooling fan to run the cooling radiator.
- cooling pumps to cool the 126 HP motor.
- lube cooling fans.
- lube pumps.
- fluorescent lights (lighting transformer and lighting panel).
- 110 volt outlet.
- 30 amp 2 ton A/C units.

In use, the system 400 is brought into the fracturing site 100 and inserted into one of the pump openings 12. The pump 406 is then attached to the manifold 14. The generator is started and the mechanicals and electrics of the system are brought up to speed. Fluid plus additives are then taken by manifold to the intake of the pump and then pumped to the well 10. The flow rate is controlled by the VFD drive.

Figure 5A:
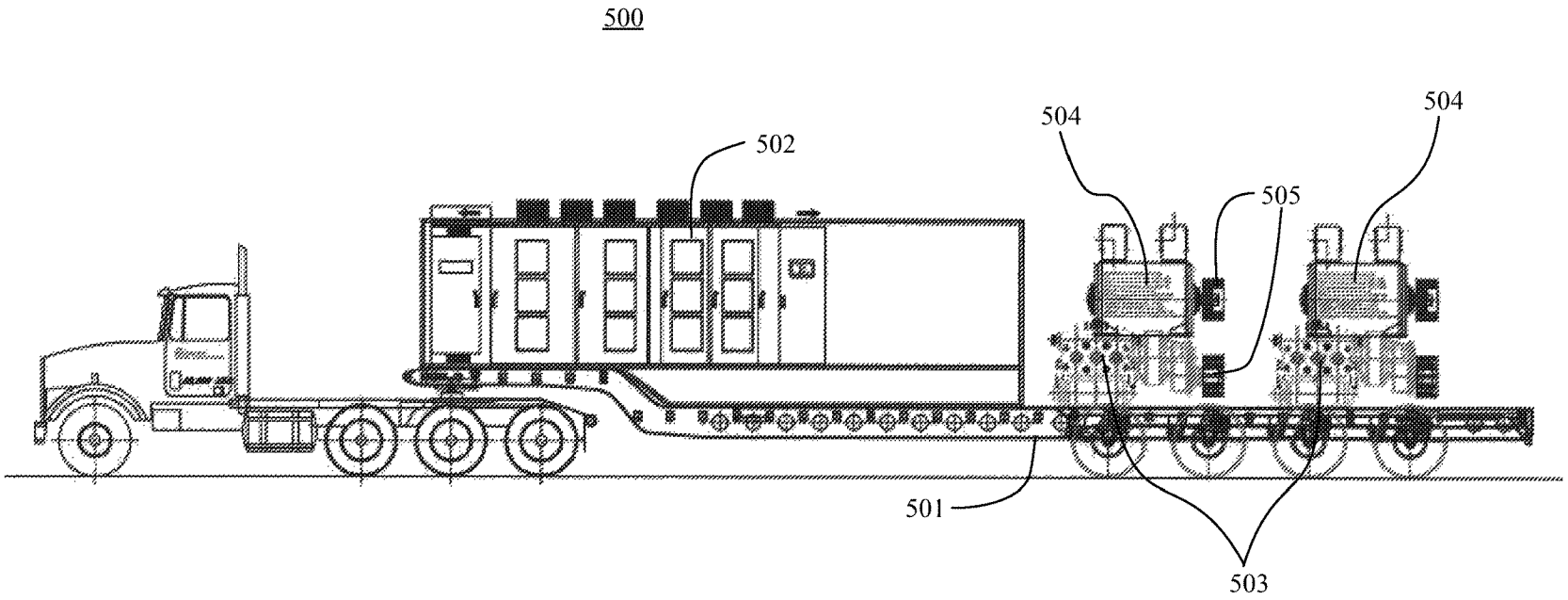
FIG. 5A shows a side view of a four axle hydraulic fracturing unit showing single horizontal electric induction motors mounted on triplex fluid pumps.
Figure 5B:
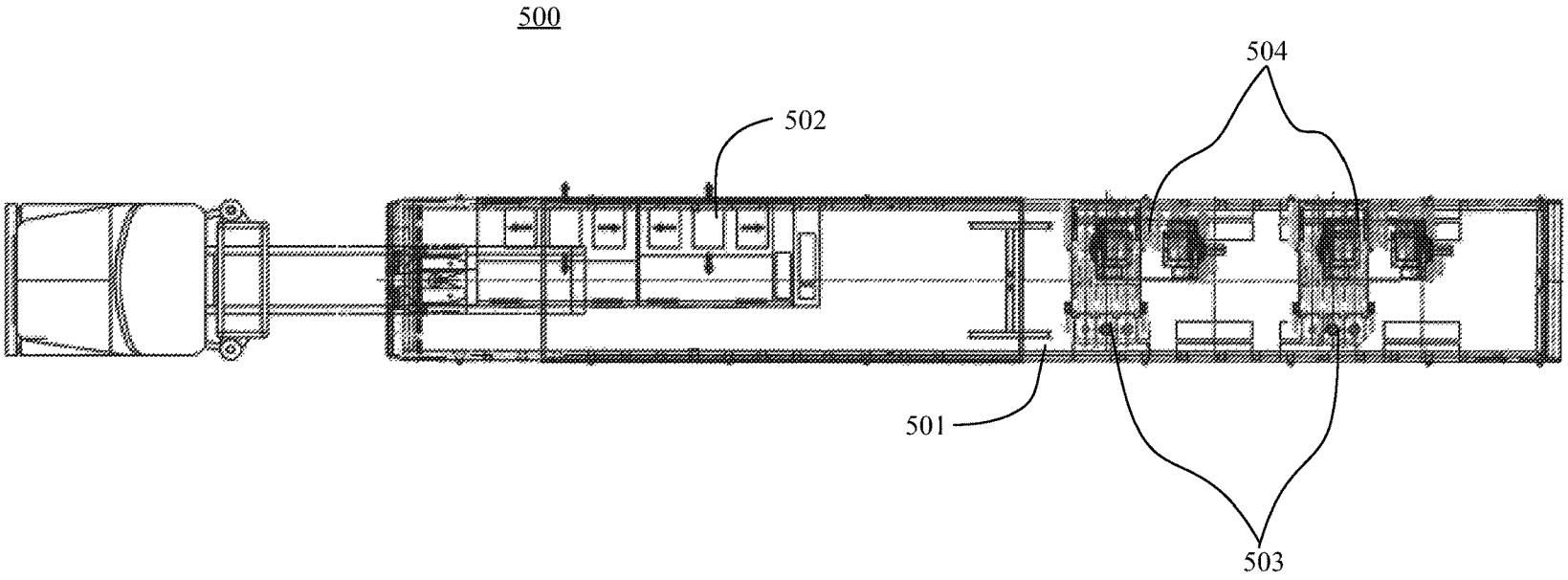
FIG. 5B shows a top view of a four axle hydraulic fracturing unit showing single horizontal electric induction motors mounted on triplex fluid pumps.

Another embodiment of the system 500 may be seen in FIGS. 5A-5B. In this system 500, the trailer 501 has mounted thereon a VFD 502, two triplex pumps 503 and a single horizontal electric induction motor 504 mounted on each pump 503. In this system 500, the pumps 503 are coupled to the induction motors 504 via pulley assemblies 505. The induction motors 504 may have, for example, the specifications as listed in Table 1.

TABLE 1

| Induction Motor Specifications | |
|---|---|
| HP | 1098 to 2800 |
| Volt | 1040 to 2800 |
| Htz | 10 to 100 |
| Poles | 6 |
| RPM | 187 to 1982 |
| Insulation | Class H |
| Ambient Temperature | 45° C. |
| Temperature Riase | 145° C. |
| Weight | 15,750 lbs. |
| Enclosure | O.D.P. Forced Ventilation |

This system 500 offers a more compact ventilation system relative to, for example, system 400, including that system 500 makes more efficient use of space (e.g., accommodate larger generators or more than one generator).

Figure 6A:
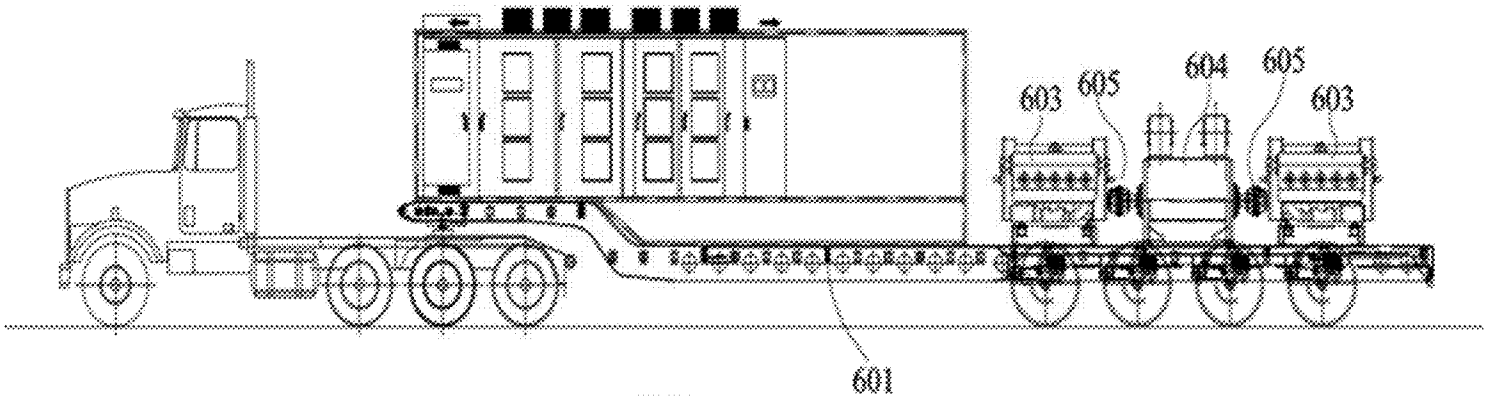
FIG. 6A shows a side view of a four axle hydraulic fracturing unit showing single horizontal electric induction motors mounted on a trailer and mechanically connected to quintuplex fluid pumps.
Figure 6B:
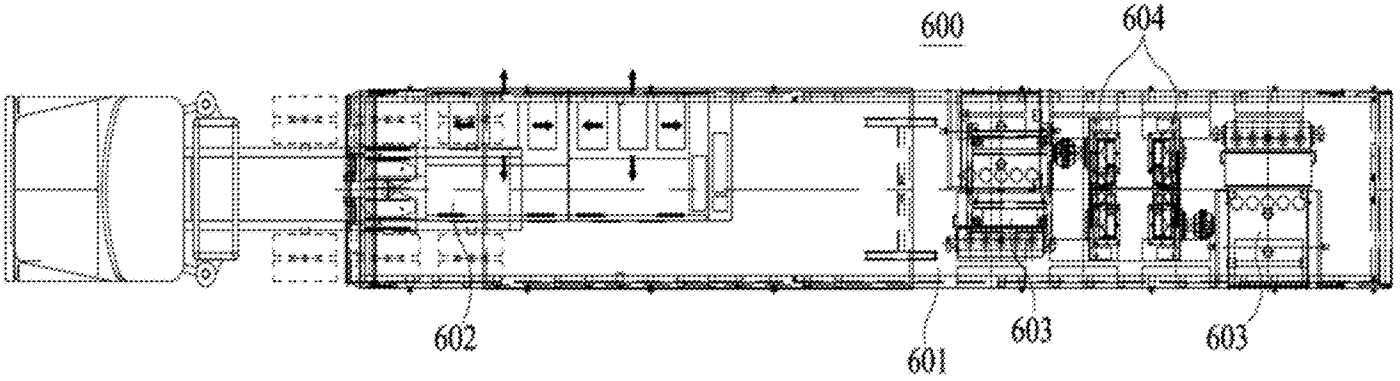
FIG. 6B shows a top view of a four axle hydraulic fracturing unit showing single horizontal electric induction motors mounted on a trailer and mechanically connected to quintuplex fluid pumps.
Figure 7A:
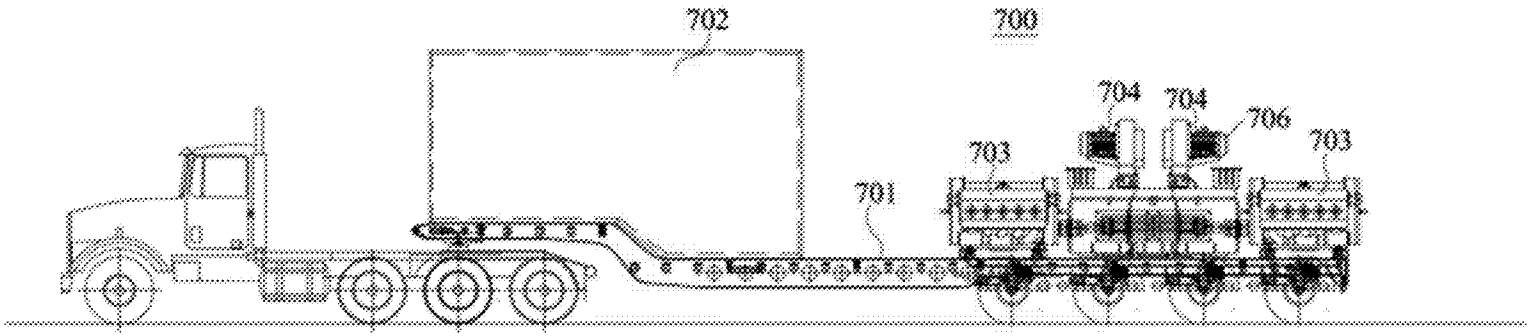
FIG. 7A shows a side view of a four axle hydraulic fracturing unit showing single horizontal electric induction motors mounted on a trailer and mechanically connected to quintuplex fluid pumps in a separate and distinct configuration with a different ventilation system relative to that of FIGS. 6A-6B.
Figure 7B:
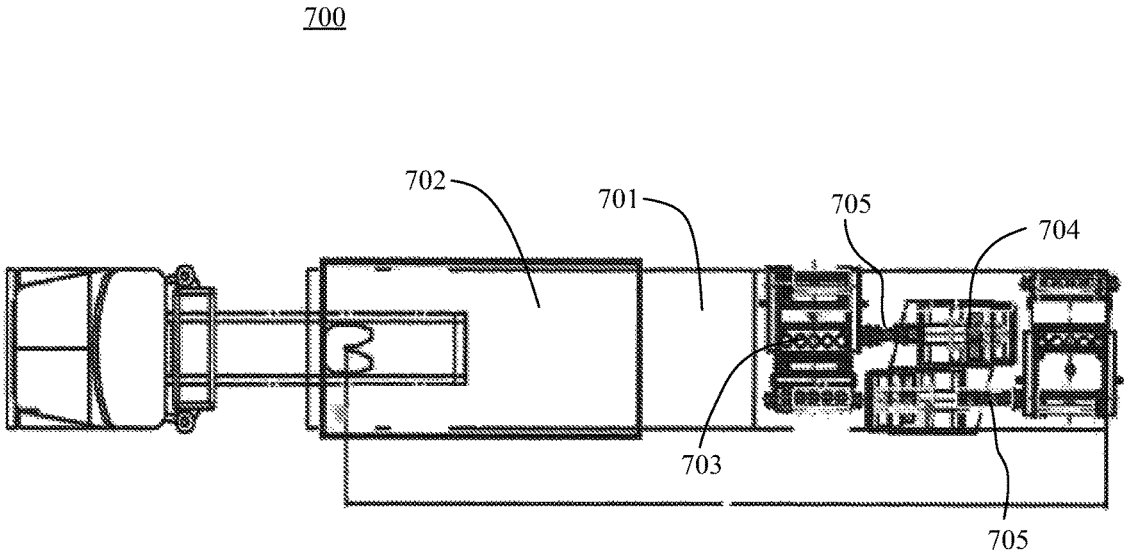
FIG. 7B shows a top view of a four axle hydraulic fracturing unit showing single horizontal electric induction motors mounted on a trailer and mechanically connected to quintuplex fluid pumps in a separate and distinct configuration with a different ventilation system relative to that of FIGS. 6A-6B.
Figure 7C:
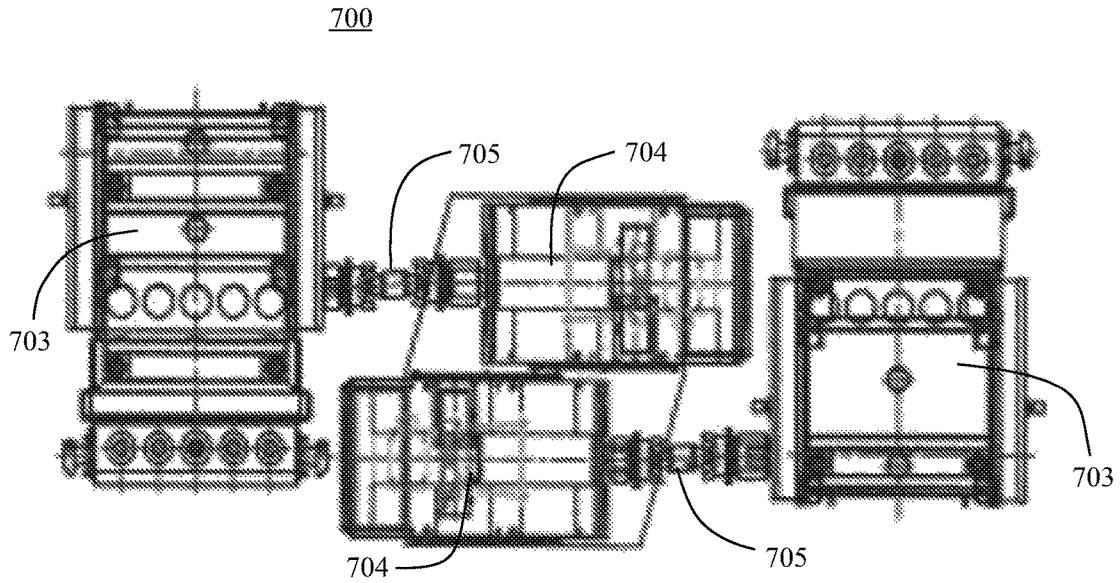
FIG. 7C shows a top view of the motors coupled to the pumps in detail.
Figure 7D:
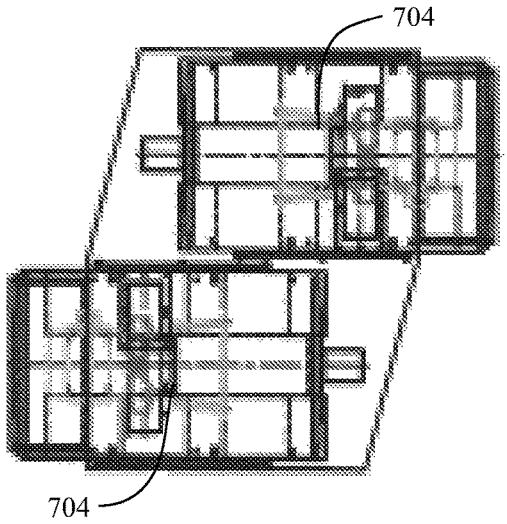
FIG. 7D shows a top view of the motors in detail.
Figure 7E:
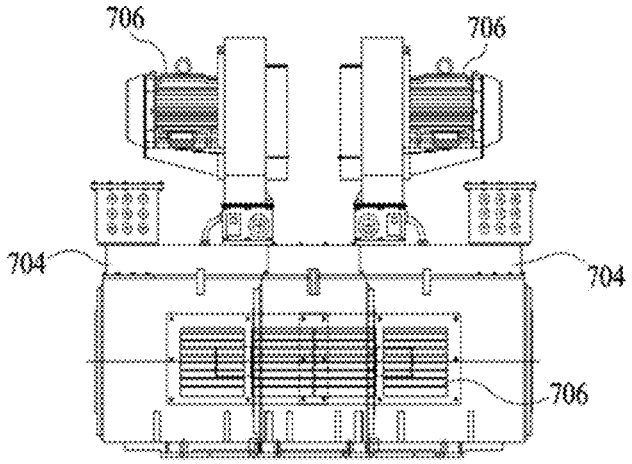
FIG. 7E show a side view of the motors in detail.
Figure 7F:
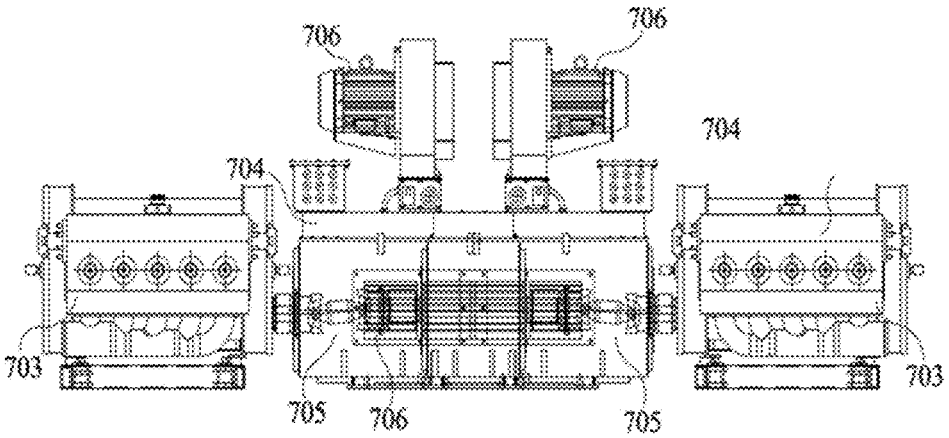
FIG. 7F shows a side view of the motor coupled to the pumps in detail.

Another embodiment of the system 600 may be seen in FIGS. 6A-6B. In this system 600, the trailer 601 has mounted thereon a VFD 602, two quintuplex pumps 603 and a single horizontal electric induction motor 604 in mechanical communication with each pump 603. In this system 600, the pumps 603 are coupled to the induction motors 604 via transmission 605. The induction motors 604 may have, for example, the same specifications as for the system 500 in FIGS. SA-5B. In this system 600, the positioning of the motors 604/pump 603 is distinct from their positioning relative to system 500. In system 600, the motors 604 are mounted to the trailer 601 and the transmissions 605 face away from a center between the motor 604/pump 603 assemblies.

Another embodiment of the system 700 may be seen in FIGS. 7A-7F. In this system 700, the trailer 701 has mounted thereon a drive house 702 (control house) which contains the VFD, load brake switch (circuit breaker) and the MCC panel, two quintuplex pumps 703 and a single horizontal electric induction motor 704 in mechanical communication with each pump 703. In this system 700, the pumps 703 are coupled to the induction motors 704 via transmission 705. The induction motors 704 may have, for example, the same specifications as for the system 500 in FIGS. SA-5B, however, the ventilation system 706 is different (forced air blower system). In this system 700, the positioning of the motors 704/pump 703 is distinct from their positioning relative to system 500 or 600. While the motors 604 are positioned such that they are relatively super-imposable when viewed from the side (FIG. 6A), in system 700 the front of the motor 704, including the crank shaft, substantially overlap and face away from each other, allowing efficient use of a shorter 40 foot step deck trailer. As in system 600, in system 700 the motors 704 are mounted to the trailer 701 and the transmissions 705 face away from a center between the motor 704/pump 703 assemblies. In embodiments, the trailer 701 may be a 46 foot step deck trailer.

The ability to transfer the equipment of the present disclosure directly on a truck body or two to a trailer increases efficiency and lowers cost. In addition, by eliminating or reducing the number of trailers that carry the equipment, the equipment may be delivered to sites having a restricted amount of space, and may be carried to and away from worksites with less damage to the surrounding environment.

The use of the technology as disclosed may be as follows: The water, sand and other components may be blended to form a fracturing fluid, which fluid is pumped down the well by the system as described. Typically, the well is designed so that the fracturing fluid may exit the wellbore at a desired location and pass into the surrounding formation. For example, in embodiments, the wellbore may have perforations that allow the fluid to pass from the wellbore into the formation. In other embodiments, the wellbore may include an openable sleeve, or the well may itself be an open hole. The fracturing fluid may be pumped into the wellbore at a high enough pressure that the fracturing fluid cracks the formation, and enters into the cracks. Once inside the cracks, the sand, or other proppants in the mixture wedges in the cracks and holds the cracks open.

Using the pump controls and data monitoring equipment as disclosed herein, an operator may monitor, gauge and manipulate parameters of operation, such as pressures, and volumes of fluids and proppants entering and exiting the well. For example, an operator may increase or decrease the ratio of sand and water as fracturing progresses and circumstances change.

In embodiments, the systems as disclosed may also be used for off-shore sites. Use of the system as described herein is more efficient than using diesel powered pumps. Fracturing systems as disclosed are smaller and lighter than the equipment typically used on the deck of offshore vessels, thus removing some of the current ballast issues and allowing more equipment or raw materials to be transported by the offshore vessels.

In a deck layout for a conventional offshore stimulation vessel, skid based, diesel powered pumping equipment and storage facilities on the deck of the vessel create ballast issues. Too much heavy equipment on the deck of the vessel causes the vessel to have a higher center of gravity. In embodiments, the system as described herein, the physical footprint of the equipment layout is reduced significantly when compared to a conventional layout. More free space is available on deck, and the weight of the equipment is dramatically decreased, thus eliminating ballast issues.

While the invention has been shown in only some of its forms, it should be apparent to those skilled in the art that it is not so limited, but is susceptible to various changes without departing from the scope of the invention. For example, while all the figures illustrate service pumps that are typically used for cementing, acidizing, or fracing, the monitoring assembly 20 could also easily be used on mud pumps for drilling operations.

While the technology has been shown or described in only some of its forms, it should be apparent to one of skill in the art that it is not so limited, but is susceptible to various changes without departing from the scope of the technology. Further, it is to be understood that the above disclosed embodiments are merely illustrative of the principles and applications of the present technology. Accordingly, numerous modifications may be made to the illustrative embodiments and other arrangements can be devised without departing for the spirit and scope of the present technology as defined by the appended claims.

All references recited are incorporated herein by reference in their entireties.

I claim:

1. A fracturing system for use at a fracturing site, the system comprising:

at least one tractor unit having multiple axles;

at least one trailer unit, the at least one trailer unit including:

one or more well service pumps;

one or more induction motors, the one or more induction motors being coupled to the well service pumps via pulley assemblies or transmissions;

one or more variable frequency drives (VFD), the one or more variable frequency drives being coupled to the induction motors;

a diesel generator coupled to the motors and VFD;

a cooling radiator coupled to the diesel generator; and a flow turbine meter measuring pre mixed gel suction rate and slurry rate; and said one or more service pumps delivering slurry to a wellbore.

2. The fracturing system of claim 1, wherein each of the one or more well service pumps is capable of supplying at least 3500 horsepower.

3. The fracturing system of claim 1, wherein each of the one or more induction motors is capable of supplying at least 2000 horsepower.

4. The fracturing system of claim 1, wherein the combined weight of a single tractor and trailer is less than 127,600 pounds.

5. The fracturing system of claim 1, wherein the one or more induction motors are mounted on the one or more well service pumps.

6. The fracturing system in claim 1, wherein the well service pump is a quintuplex plunger-style fluid pump.

7. The fracturing system of claim 1, wherein the well service pump is a triplex plunger-style fluid pump.

8. The fracturing system of claim 1, wherein the at least one trailer includes two well service pumps and each well service pump is coupled to two induction motors.

9. The fracturing system of claim 8, wherein the at least one trailer includes two 3000 horsepower quintuplex plunger-style fluid pumps, two A/C induction motors mounted on each fluid pump capable of supplying at least 1600 horsepower, two 4000 horsepower A/C VFDs, a VFD cooling system, and an auxiliary diesel generator, wherein said auxiliary diesel generator powers auxiliary equipment, lube pumps, and cooling fans, and wherein said induction motors and fluid pump are coupled via pulley assemblies.

10. The fracturing system of claim 1 wherein the at least one trailer includes one well service pump coupled to one induction motor.

11. The fracturing system of claim 10, wherein the at least one trailer includes one 3500 horsepower quintuplex plunger-style fluid pump, an A/C induction motor capable of supplying at least 2000 horsepower, a 4000 horsepower A/C VFD drive, and an auxiliary diesel generator, wherein said auxiliary diesel generator powers auxiliary equipment, lube pumps, and cooling fans, and wherein said induction motor and fluid pump are coupled via transmission.

12. The fracturing system of claim 1, wherein induction motor function is diagnosed via separate operator interface terminal.

13. The fracturing system of claim 1, wherein the well service pumps and induction motors are horizontal.

14. The fracturing system of claim 1, wherein the system is configured to be disposed at one or more on shore locations and one or more off-shore locations.

15. A fracturing system for use at a fracturing site, the system comprising:

at least one tractor unit having multiple axles;

at least one trailer unit having multiple axles releasably coupled with the at least one tractor unit, the at least one trailer unit including:

one or more well service pumps, wherein said service pumps are quintuplex or triplex plunger-style fluid pumps;

one or more induction motors with cooling fans, the one or more induction motors being coupled to the well service pumps via pulley assemblies or transmissions;

one or more variable frequency drives (VFD) with a cooling system, the one or more variable frequency drives being coupled to the induction motors;

a diesel generator coupled to the motors and VFD; and a flow turbine meter measuring pre mixed gel suction rate and slurry rate; and said one or more service pumps delivering slurry to a wellbore.

16. The fracturing system of claim 15, wherein the at least one trailer includes two 3000 horsepower quintuplex plunger-style fluid pumps, two A/C induction motors mounted on each fluid pump capable of supplying at least 1600 horsepower, two 4000 horsepower A/C VFDs, a VFD cooling system, and an auxiliary diesel generator, wherein said auxiliary diesel generator powers auxiliary equipment, lube pumps, and cooling fans, and wherein said induction motors and fluid pump are coupled via pulley assemblies.

17. The fracturing system of claim 15, wherein the at least one trailer includes one 3500 horsepower quintuplex plunger-style fluid pump, an A/C induction motor capable of supplying at least 2000 horsepower, a 4000 horsepower A/C VFD drive, and an auxiliary diesel generator, wherein said auxiliary diesel generator powers auxiliary equipment, lube pumps, and cooling fans, and wherein said induction motor and fluid pump are coupled via transmission.

18. A method of delivering fracturing fluid from surface to a wellbore, the method comprising:

providing to a wellbore site at least one trader unit including components, the components including:

one or more well service pumps, one or more induction motors with cooling fans, the one or more induction motors being coupled to the well service pumps via pulley assemblies or transmissions, one or more variable frequency drives (VFD) with a cooling system, the one or more variable frequency drives being coupled to the induction motors, a diesel generator coupled to the motors and VFD, a cooling radiator coupled to the diesel generator, and a flow turbine meter measuring pre mixed gel suction rate and fracturing fluid rate; and operating the components in said trailer unit to pump said fracturing fluid from the surface to the wellbore.

19. The method of claim 18, wherein the at least one trailer includes two 3000 horsepower quintuplex plunger-style fluid pumps, two A/C induction motors mounted on each fluid pump capable of supplying at least 1600 horsepower, two 4000 horsepower A/C VFDs, a VFD cooling system, and an auxiliary diesel generator, wherein said auxiliary diesel generator powers auxiliary equipment, lube pumps, and cooling fans, and wherein said induction motors and fluid pump are coupled via pulley assemblies.

20. The method of claim 18, wherein the at least one trailer includes one 3500 horsepower quintuplex plunger-style fluid pump, an A/C induction motor capable of supplying at least 2000 horsepower, a 4000 horsepower A/C VFD drive, and an auxiliary diesel generator, wherein said auxiliary diesel generator powers auxiliary equipment, lube pumps, and cooling fans, and wherein said induction motor and fluid pump are coupled via transmission.

21. A fracturing system for use at a fracturing site, the system comprising:

at least one tractor unit having multiple axles;

at least one trailer unit, the at least one trailer unit including:

one or more well service pumps; one or more horizontal induction motors, the one or more induction motors being coupled to the well service pumps via pulley assemblies or transmissions;

one or more variable frequency drives (VFD) with a cooling system, the one or more variable frequency drives being coupled to the induction motors;

a diesel generator coupled to the motors and VFD;

a cooling radiator coupled to the diesel generator; and a flow turbine meter measuring pre mixed gel suction rate and slurry rate; and said one or more service pumps delivering slurry to a wellbore.

22. The fracturing system of claim 21, wherein the at least one trailer includes two triplex plunger-style fluid pumps, two A/C induction motors mounted on each fluid pump capable of supplying at least 1600 horsepower, two 4000 horsepower A/C VFDs, a VFD cooling system, and an auxiliary diesel generator, wherein said auxiliary diesel generator powers auxiliary equipment, lube pumps, and cooling fans, and wherein said induction motors and fluid pump are coupled via pulley assemblies.

23. The fracturing system of claim 21, wherein the at least one trailer includes one 3500 horsepower quintuplex plunger-style fluid pump, an A/C induction motor capable of supplying at least 2000 horsepower, a 4000 horsepower A/C VFD drive, and an auxiliary diesel generator, wherein said auxiliary diesel generator powers auxiliary equipment, lube pumps, and cooling fans, and wherein said induction motor and fluid pump are coupled via transmission.

24. The fracturing system of claim 22, wherein the trailer is a 46 foot step deck trailer or a 40 foot step deck trailer.

25. A method of delivering fracturing fluid from surface to a wellbore, the method comprising:

providing to a wellbore site at least one trailer unit including components, the components including:

(i) a two triplex plunger-style fluid pumps, two A/C induction motors mounted on each fluid pump supplying at least 1600 horsepower, two 4000 horsepower A/C VFDs, a VFD cooling system, and an auxiliary diesel generator, wherein said auxiliary diesel generator powers auxiliary equipment, lube pumps, and cooling fans, and wherein said induction motor and fluid pump are coupled via pulley assemblies or (ii) two quintuplex plunger-style fluid pumps, two A/C induction motors mounted on the trailer supplying at least 1600 horsepower, two 4000 horsepower A/C VFDs, a VFD cooling system, and an auxiliary diesel generator, wherein said auxiliary diesel generator powers auxiliary equipment, lube pumps, and cooling fans, and wherein said induction motor and fluid pump are coupled via pulley assemblies; and (iii) a flow turbine meter measuring pre mixed gel suction rate and fracturing fluid rate; and operating the components in said trailer unit to pump said fracturing fluid from the surface to the wellbore.

* * * * *